US005389350A

United States Patent [19]

Freeman et al.

[11] Patent Number: 5,389,350

[45] Date of Patent: Feb. 14, 1995

[54] GAS SEPARATION USING ADSORBENT ACTIVATED CARBONIZED POLYARYLAMIDES

[75] Inventors: John J. Freeman, Middlesex; Frederick G. R. Gimblett, Reading, both of United Kingdom; Robert A. Hayes, Pooraka, Australia; Kenneth S. W. Sing, Ilminster, United Kingdom

[73] Assignee: The Secretary of State for Defence in Her Britannic Majesty's Government of the United Kingdom of Great Britain and Northern Ireland, Whitehall, United Kingdom

[21] Appl. No.: 867,686

[22] PCT Filed: Dec. 21, 1990

[86] PCT No.: PCT/GB90/02008

§ 371 Date: Jul. 9, 1992

§ 102(e) Date: Jul. 9, 1992

[87] PCT Pub. No.: WO91/10000

PCT Pub. Date: Jul. 11, 1991

[30] Foreign Application Priority Data

Dec. 28, 1989 [GB] United Kingdom ..... 8929259

[51] Int. Cl.[6] ..... C01B 31/20; C01B 31/08; C01C 3/04; B01D 53/02

[52] U.S. Cl. ..... 423/230; 95/139; 423/236; 423/447.1; 502/416; 502/437

[58] Field of Search ..... 502/416, 437; 423/447.1, 230; 95/139

[56] References Cited

U.S. PATENT DOCUMENTS

| | | | |
|---|---|---|---|
| 4,046,525 | 9/1977 | Matsuo et al. | 55/59 |
| 4,073,869 | 2/1978 | Kalnin | 423/447.1 |
| 4,118,341 | 10/1978 | Ishibashi et al. | 502/437 |
| 4,401,588 | 8/1983 | Turner | 423/447.1 |

FOREIGN PATENT DOCUMENTS

| | | |
|---|---|---|
| 1583315 | 10/1969 | France . |
| 2302128 | 9/1976 | France . |
| 2411256 | 7/1979 | France . |

*Primary Examiner*—Paul E. Konopka
*Attorney, Agent, or Firm*—Nixon & Vanderhye

[57] ABSTRACT

Novel polyarylamide derived activated carbon materials are provided by a process comprising the carbonization of polyarylamide fibre at a temperature in excess or 400° C. followed by activation at elevated temperature. The novel materials have the ability to adsorb relatively large quantities or carbon dioxide compared to other activated carbonized polymer materials, Preferably the carbonization and activation steps are carried out by raising the temperature of the materials to between 840° C. and 880° C. in carbonizing/activating atmospheres respectively.

17 Claims, 11 Drawing Sheets

GAS SEPARATION USING ADSORBENT ACTIVATED CARBONIZED POLYARYLAMIDES

This invention relates to a process for the preparation of activated carbons by pyrolysis of polyarylamides, to adsorbent activated carbon materials produced by the said process and to uses for these materials.

Adsorbent activated carbons are widely used for the absorption of materials, in particular gases, for example in industrial filtration, air purification, and respirators. Such carbon materials are also used in decolourisation, for example to remove coloured impurities from solutions, and as supports for catalysts. Often such materials are quite effective at removing large organic molecules from the air but are less effective at removing smaller molecules such as carbon dioxide.

These carbon materials are generally prepared by carbonization (pyrolysis) of an organic precursor in an inert atmosphere at an elevated temperature, followed by activation in an activating atmosphere, also at an elevated temperature. Often it is also necessary to treat the precursor or the carbonized product with various chemicals, such as metal compounds, to ensure or to improve the activated product.

Fibrous activated carbons are currently manufactured from a number of precursors including fibrous carbohydrates, viscous rayon, polyacrylonitrile ('PAN'), phenolic resins and coal tar pitch. These materials provide a group of increasingly important adsorbents in both liquid and vapour phase applications. Those derived from rayon are particularly versatile in terms of the range of pore sizes which can be formed during activation, after appropriate pretreatment with aqueous impregnants. Such materials are for example described in GB 1301101 and GB 2164327.

Viscous rayon is a form of regenerated cellulose having quite low crystallinity. Some investigations have been carried out into the possibility of using more ordered fibrous precursors for preparation of activated carbon materials. Among more recently developed high-performance polymers polybenzimidazole (see U.S. Pat. No. 4,460,708) is claimed to be a promising precursor for activated carbon production but requires a pre-oxidation stage to stabilise the polymer and also requires chemical pre-treatment to form a salt prior to carbonization. PAN also requires a pre-oxidation stage.

It was suggested in GB 1515874 that aromatic polyamides might be suitable for formation of active carbon materials. This document teaches the impregnation of fibres with flame retardant agent, carbonization at up to 400° C. in an oxygen containing atmosphere followed by activation with 10 to 70% by volume of steam with carbon dioxide and carbon monoxide at above 500° C. No data for such polyamides is given, only cellulose and polyacrylonitrile fibres being exemplified. Tomizuka et al, Tanso 106 (1981), 93, reported investigating production of carbon fibres from Kevlar but hitherto no attempt has been made to develop a pore structure in chars derived from this polymer by gaseous activation.

'Kevlar' is a condensation product of 1,4-diaminobenzene and terephthalic acid, the resulting polymer being a polyarylamide having the repeat unit;

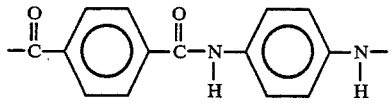

Kevlar fibres are highly crystalline and according to Dobb et al. J Polym. Symp. 58 (1977) 237 and J Polym. Sci. Polym. Phys. Ed. 15 (1977) 2201, consist of a system of sheets regularly pleated along their long axes and arranged radially. The relatively small amount of disorder in the structure is due to chain termination or defects in the packing of these sheets. A similar fibre is sold by the trademark 'Twaron' by Akzo NV.

Further known aromatic polyaramide fibres are sold under the trademark 'Nomex' and result from polymerising 1,3-diaminobenzene with isophthalic acid to provide a copolymer with the repeat unit

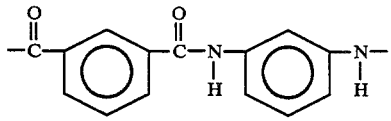

these also never having being reported as being carbonized and gaseously activated. The materials are available in various forms, including, e.g. Kevlar pulp (used as an asbestos replacement) and all such forms are considered to have potential for use with the present invention.

It is an object of the present invention to provide novel fibrous adsorbent activated carbon materials having improved or alternative adsorption characteristics enabling novel uses, and also to provide a novel process for the preparation of such materials.

According to the present invention a process for preparing a fibrous adsorbent activated carbon is provided including the steps of carbonizing a material comprising polyarylamide fibre at a temperature above 400° C. and activating the carbonized product in an activating atmosphere at an elevated temperature. The process of the invention may also include the additional step of washing the polyarylamide fibre with acid, alkali and/or organic solvent prior to carbonization.

By 'polyarylamide' herein is meant a polymeric material having a backbone containing aromatic ring systems linked by amide links; examples of these being 'Nomex'. 'Kevlar'. 'Twaron' and the copoly-(p-phenylene-3,4'-diphenyl ether terephthalamide) Technora fibres (the latter described in "Aromatic High-Strength Fibres" by H. H. Yang. pub. Wiley Interscience, 1990 -pages p268–269).

Preferred polyarylamides comprise the repeat unit:

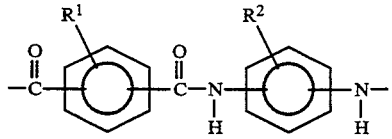

wherein $R^1$ and $R^2$ are independently alkyl or hydrogen, more preferably both $R^1$ and $R^2$ are hydrogen and the polyarylamide is a condensation product of 1,3 or 1,4 diaminobenzene and terephthalic or isophthalic acid, especially the commercially available 'Nomex', 'Kevlar' or 'Twaron' materials. The diameter of the fibre used is not critical to the process, but it is found that the smaller the diameter, the more flexible the final product will tend to be, especially with 'Kevlar' based materials, and the higher its specific surface area will be. Both flexibility and high surface area are desirable characteristics. The fibres might be in any convenient form, including single fibre, woven or knitted cloth, yarn, filament, thread, tow, non-woven cloth, web, felt, pulp or fabric. During the process the physical shape of the fibre is largely retained but some shrinkage may occur.

The carbonization step is preferably carried out at above 500° C., more preferably 575° C. to 950° C., most preferably 615° C. to 900° C. and particularly 840° C. to 880° C., Thermal analysis data for heating such polyarylamide fibre as Kevlar indicates a major DTA peak at around 615° C., with a shoulder at around 575° C., suggesting a minimum temperature for the carbonization step of around 600° C. There appears to be no practical advantage in heating above 950° C. Preferably the fibre temperature is raised gradually to the carbonization temperature, conveniently at 1 to 20° C. $min^{-1}$, preferably 5° to 15° C. $min^{-1}$ e.g., about 10° C. per minute; slower heating rates increasing carbonization yield. The carbonization is carried out in a standard carbonization gas (at least non-oxidizing) atmosphere, e.g. at least nominally oxygen free nitrogen, with oxygen free activation gases such carbon dioxide also being useable. Preferably a flow of this gas is passed through the furnace in which the carbonization is done so as to carry away volatile pyrolysis products. The time for which the fibre is maintained at the carbonization temperature will vary with the weight of the starting fibre, but in each case carbonization may be deemed to be complete when the rate at weight loss resulting from the carbonization drops substantially or becomes zero.

The activation step is preferably carried out at between 600° C. and 950° C., more preferably 840° C. and 950° C., e.g. 800° C. to 900° C., again the most preferred temperature lying between 840° C. and 880° C. This step may therefore conveniently be carried out after carbonization by maintaining the temperature of the carbonized fibre in the furnace and replacing the carbonizing atmosphere with an activating atmosphere. Suitable gases for use as the activating atmosphere are those conventional to the art, but preferred gases are carbon dioxide, steam, hydrogen, combustion gases derived from hydrocarbon fuels or mixtures thereof, especially carbon dioxide. The activating atmosphere should again be as free as possible of oxygen, and should be passed through the furnace to carry away volatile material liberated during activation. Both in carbonization and activation the pressure of the gas does not seem to be critical and atmospheric pressure can be used.

The time for which activation is carried out will again depend upon the weight of the starting fibre. An indication that activation has occurred to a useful extent is best obtained by monitoring the weight of the fibre during the process. It is found that a considerable weight loss ("burn-off") occurs during activation as well as carbonization. To achieve a useful degree of activation it is preferred to carry out the activation step until an overall burn-off of 25–75% of the original starting weight of the fibre has occurred, preferably 40–60%, corresponding to 73–91% and 78–85% overall weight loss.

After activation, the product is preferably allowed to cool to ambient temperature in an inert atmosphere, which may conveniently be the same gas used in the carbonization step. The rate of cooling does not appear to be critical but it may be advisable to cool gently to avoid thermal shock.

The optional additional washing step may be carried out by soaking the fibres in the treatment liquid, preferably for up to 48 hours, followed by washing with deionised or distilled water then drying. Oven drying e.g. 60° C. for 12 hours is convenient. A preferred wash is with acid, particularly hydrochloric, up to a 3M concentration, as this is volatile and non-oxidizing. Certain processes used to manufacture Kevlar tend to introduce heavy metal residues into the fibres. The acid wash is quite effective at removing these, with a consequent reduction in the extent of fibre granulation during activation. Acid wash does not however appear to remove potassium, calcium or sulphur residues, The carbonization, activation, cooling and washing steps may be carried out using apparatus which is entirely conventional to the art of preparation of fibrous activated carbons.

The process of the invention provides advantageous products as described in the examples below, but also has the advantage that no pre-oxidation or other pretreatment step is necessary before carbonization, so that, e.g., fibre may be fed straight from the supplier's roll into the carbonization furnace.

The products of the above process, being a fibrous adsorbent carbon comprising a polyarylamide fibre which has been carbonized and then activated according to the said process, are a further aspect of this invention, as are further forms wherein the product has been further treated, e.g., to achieve division e.g., by processes such as granulation or powdering.

Thus the present invention further provides specific preferred products of the process of the invention being fibrous adsorbent carbon materials comprising carbon, nitrogen and sulphur in the ratio range 100:9:0.5 to 100:10:1.5, having a carbon dioxide retention $E\,v_{retained}$ of at least 0.5 $cm^3\,g^{-1}$ at 40° C. and having carbonized aromatic ring structures therein characteristic of carbonized aromatic, particularly carbonized polyarylamide structures. Preferably the material has a nitrogen gas adsorption $V_P^N$ of at least 0.24 $cm^3\,g^{-1}$ at 77° K.

Preferably the fibrous adsorbent carbon material has a carbon dioxide retention value $E\,v_{retained}$ of at least 1.4 $cm^3\,g^{-1}$.

It will be appreciated that the carbonized aromatic ring structures will usually be connected in chains with spacings between rings characteristic of the carbonized amide bonds; such rings being visualized by e.g., electronmicroscopy and being identifiable by simple comparison with the structures of Kevlar or Nomex fibres that have been treated by the process of the present invention.

The product produced from fibrous material is an adsorbent fibrous carbon. Nitrogen isotherms of the Kevlar product display some type 1 character (as defined by the IUPAC classification) but it may also display a small hysteresis loop. Carbon activated to low percentage burn-offs, e.g. around 25–30% for Kevlar, exhibits low pressure hysteresis.

Neoprene isotherms of the Kevlar product differ from those of nitrogen in a number of respects. For example all such isotherms exhibit low pressure hysteresis, although at high percentage burn-offs, e.g. around 70% the isotherms are almost reversible at low relative pressures.

Although acid pre-washing appears to make very little difference to the nitrogen and neopentane adsorption isotherms, it is found that the maximum uptake of the product from an unwashed precursor is greater than that derived from a washed precursor. However it is found that if the carbonized fibre is activated to a burn-off greater than 40% there is a sharp reduction in the ratio of the volume of water adsorbed to the volume of nitrogen adsorbed at saturation. This means that the higher burn-off materials are, in terms of their relative up-take of water, surprisingly hydrophobic.

A significant characteristic of the products are their affinity for polar molecules and in particular for carbon dioxide. Using a Kevlar fibre precursor, a carbon product may be prepared which can adsorb around 300 times the volume of carbon dioxide than the carbon cloths derived from a viscose rayon precursor. Moreover the latter shows little ability to separate carbon dioxide from air or other gaseous mixtures, in marked contrast to the product derived from Kevlar by the process of the invention.

The adsorbent carbons produced by the process of the invention may be used in an adsorption process and/or apparatus, or as a catalyst support, and such uses are further aspects of the invention. For example the carbon material may be used in the separation of components of a gaseous mixture by preferential adsorption of selected components of the mixture, such as in the separation of toxic gases from air or carbon dioxide from less adsorbed gases. The carbons may also be used for the separation of compounds from solution, such as for use in filtration, decolourisation, chromatography or other such purification methods. Adsorption apparatus for use in such processes may incorporate the carbons in an adsorbent bed, a filter, a membrane, a column, a breathing apparatus such as a respirator or in an air conditioning system. In such apparatus the carbons may for example be in the form of a bed, or impregnated onto a support material such as a fabric. A particular process and apparatus may be used to separate polar molecules from air.

Using present materials having 40% or more burn off, apparatus may be provided for removal of carbon dioxide from moist or humid air. The hydrophobic nature of high burn-off materials of the invention, and/or the affinity for adsorption of carbon dioxide suggests particular usefulness in breathing air purification in high humidity environments where carbon dioxide accumulation might be a problem. Such environments include for example submarines, diving apparatus, caves, mines, industrial environments etc. At present carbon dioxide is usually removed from air by alkaline chemical absorbents or by dissolving in water under pressure. The materials of the invention provide an alternative for some applications which avoids the hazards of chemical absorbents and the complexity of water absorption equipment, and also provides the possibility of regeneration for example by repeating the activation step on a used carbon material.

The affinity of the materials of the present invention for polar molecules suggests particular usefulness as a support for catalytically active species which it can adsorb from solution, and become impregnated thereupon. An example of such a catalyst is the Cu/Cr system used to remove hydrogen cyanide.

BRIEF DESCRIPTION OF THE DRAWINGS

The invention will now be described by way of example only with reference to FIGS. 1 to 15 which show.

1. Carbosieve; 2. Woven viscose rayon char JF516 I; 3. Woven Kevlar 39 char; 4. Silicalite; 5. Vulcan-3.

Figure 8:
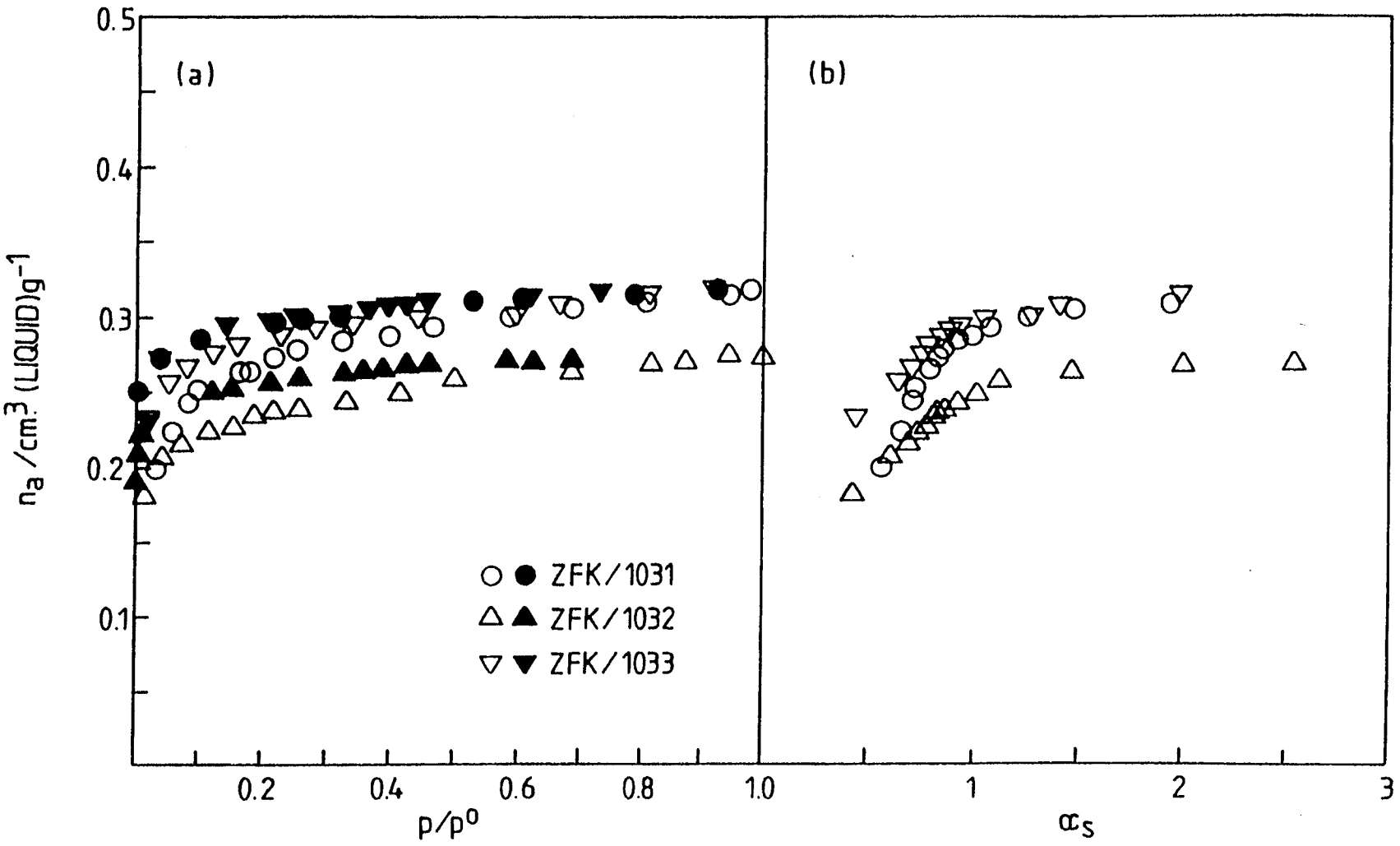

FIG. 8. (*a*) isotherms and (*b*) $\alpha_s$-plots for the adsorption of neopentane at 273° K. on activated non-woven Kevlar 29 chars.

Figure 9:
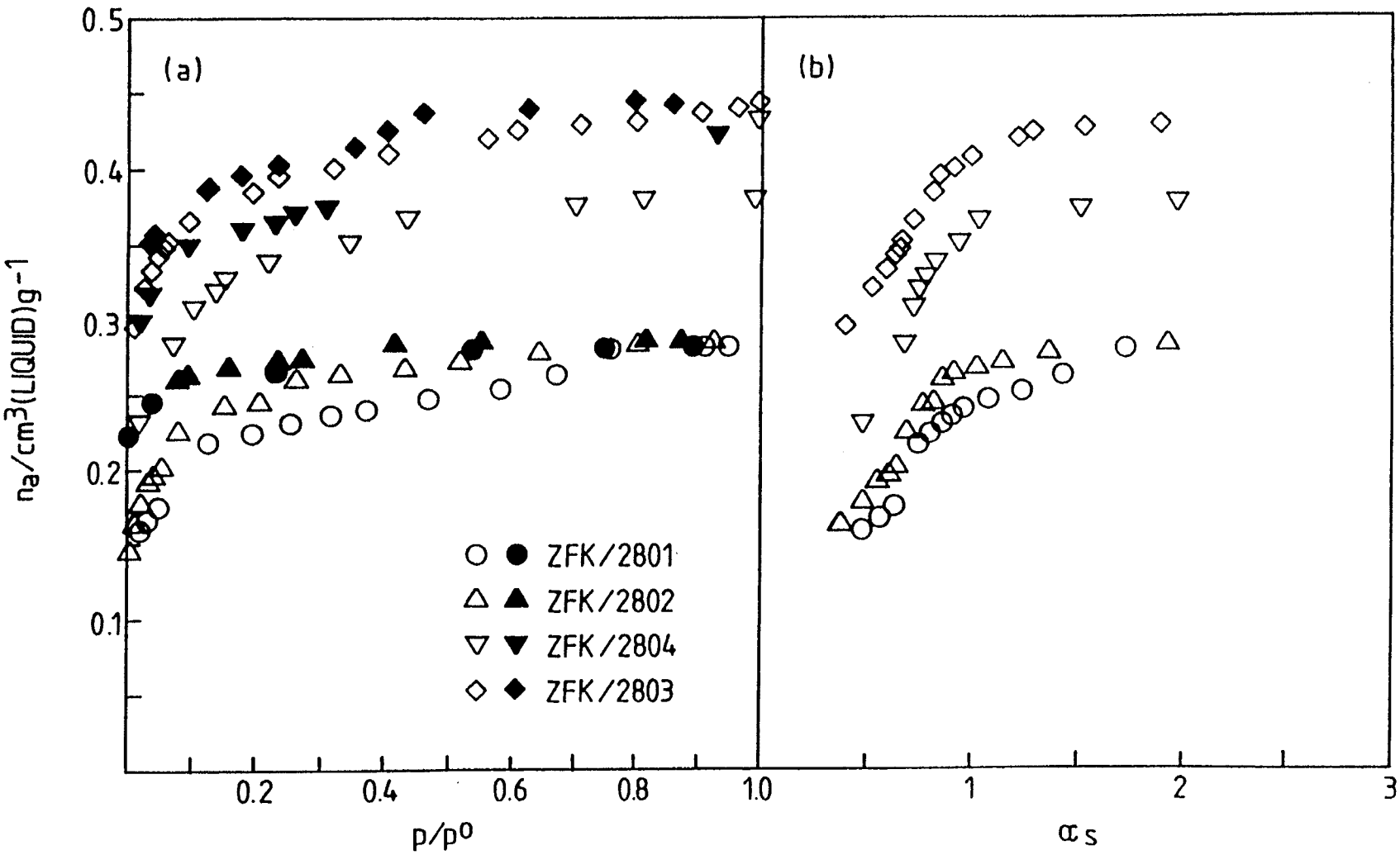

FIG. 9. (*a*) isotherms and (*b*) $\alpha_s$-plots for the adsorption of neopentane on activated woven Kevlar 29 chars.

Figure 10:
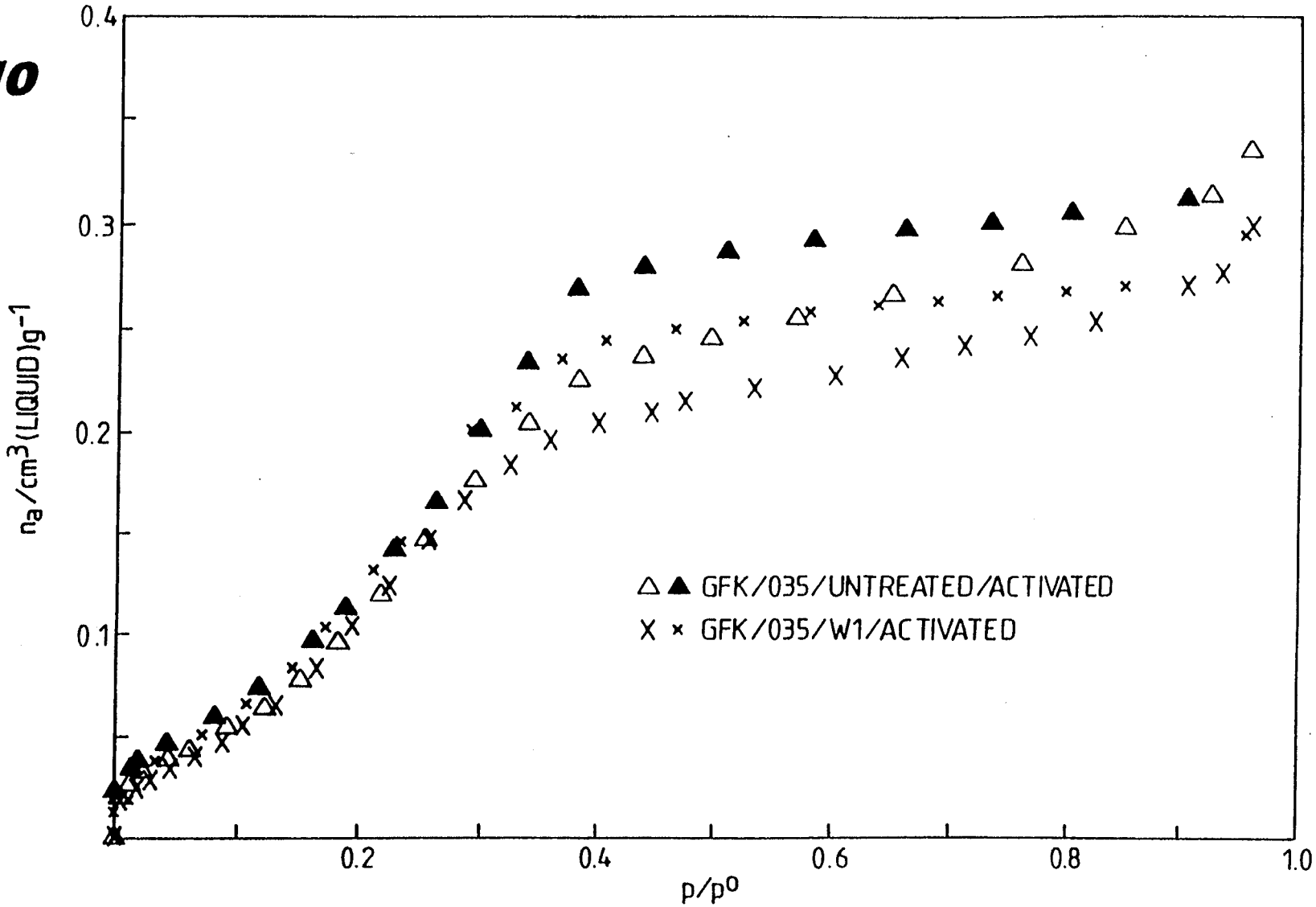

FIG. 10. Water sorption isotherms at 298° K. on activated woven Kevlar chars derived from unwashed and acid washed (3M) precursors.

Figure 11:
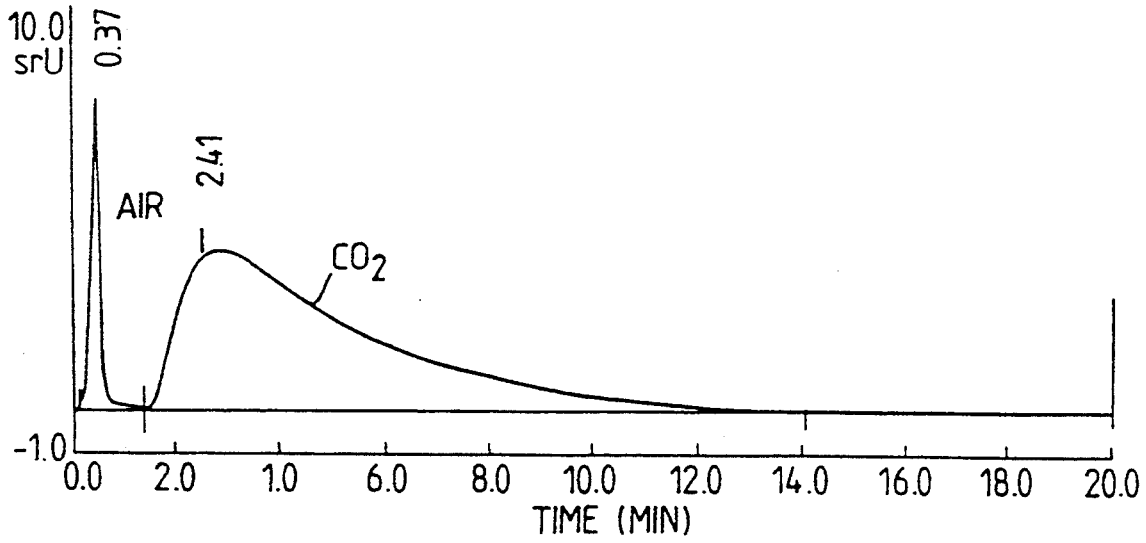

FIG. 11. Carbon dioxide chromatogram for a column containing 30 layer of woven Kevlar char ZFK60W activated to 60% burn-off and pre-saturated with $CO_2$ gas illustrating excellent separation from air.

Figure 12:
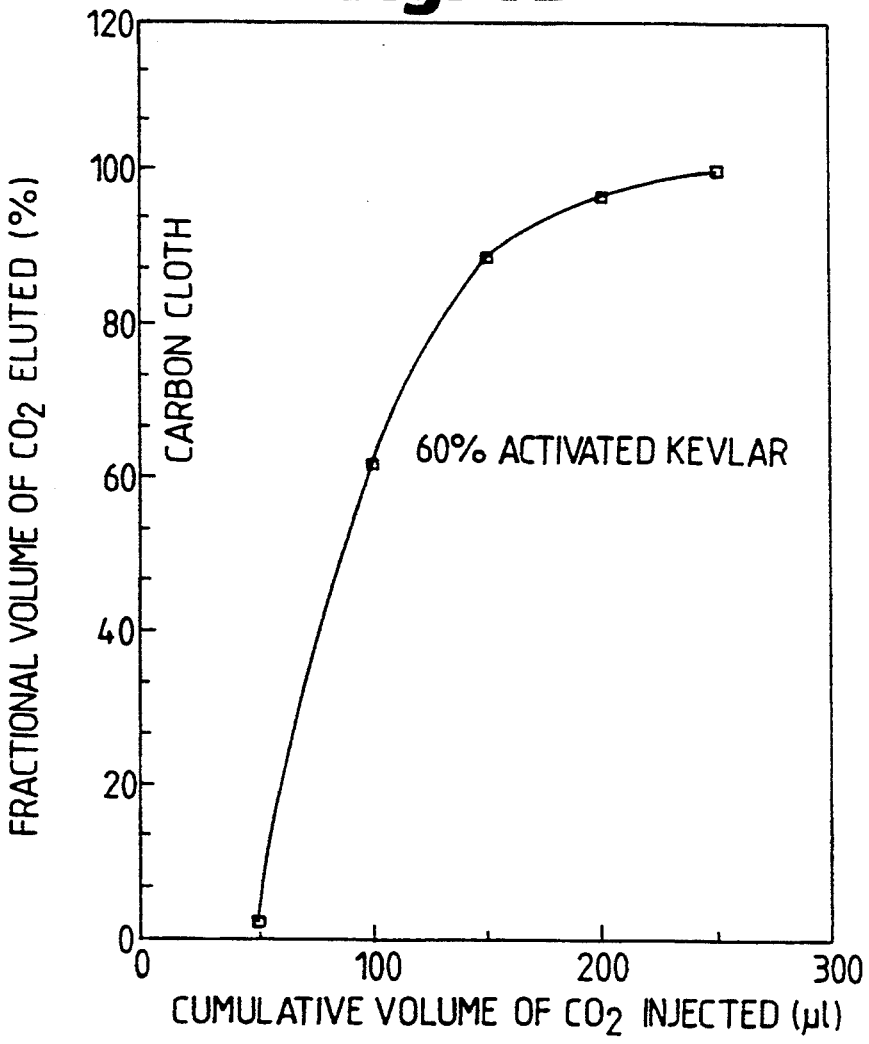

FIG. 12. Carbon dioxide breakthrough curves for chars derived from woven samples of Kevlar 29 and viscose rayon, subsequent to both being activated to 60% burn-off in $CO_2$ gas at 860° C.

Figure 13:
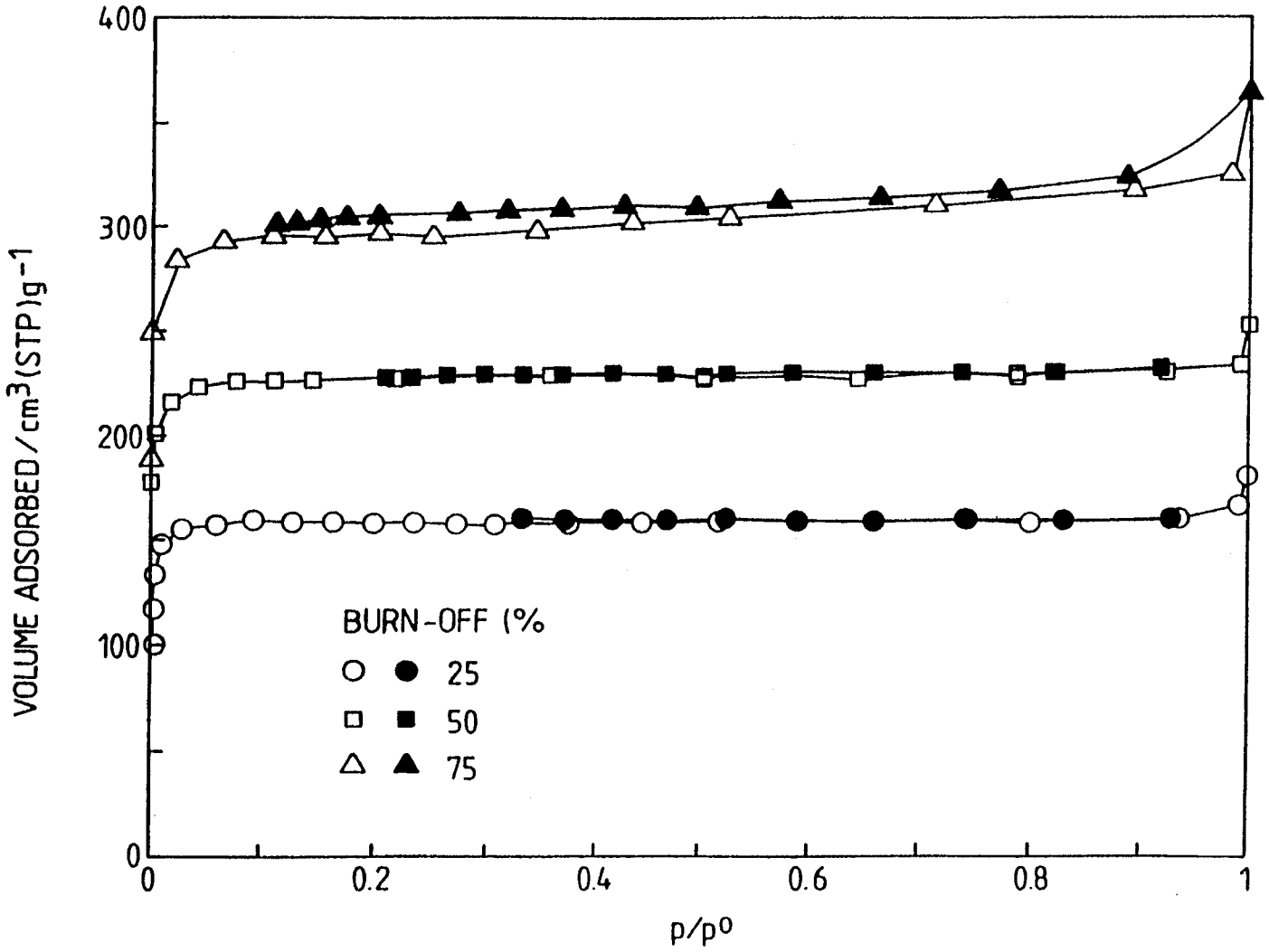

FIG. 13. Nitrogen adsorption isotherms at 77° K. for activated Nomex chars.

The following terms used in this description are Trade Marks: Kevlar, Kevlar 29, Carbosieve S, Silicalite, Vulcan-3, Arrowsafe K103. Arrowsafe K280, Nomex, AnalaR and Electrobalance.

The process and products of the present invention will now be illustrated, by way of example only, by reference to the following preparation protocols and results tables.

1. EXAMPLE 1: Preparation of activated chars from Kevlar

Samples of two Kevlar 29 textiles were obtained from P & S Textiles Ltd, Bury, Lancs., being a non-woven felt, Arrowsafe K103, and a plain-weave cloth, Arrowsafe K280, respectively. A sample of Kevlar 29 yarn was obtained from the Scottish College of Textiles, Galashiels. These samples were used as received for experimental purposes. In those cases where the precursor was washed before carbonization and activation, the cloth employed was Type D0235/001 supplied by Fothergill Engineered Fabrics Ltd., Littleborough, Lancs. with a weave identical to Arrowsafe K280. Such washing was achieved by soaking pieces of the cloth for 48 hours in aqueous solutions of hydrochloric acid (AnalaR grade) of various strengths up to 3M and, after removal from the acid solutions, careful washing with distilled water followed by drying overnight in an oven maintained at 60° C.

Strips of the unwashed/washed textiles were cut (approximate dimensions, 6×1.5 cm) and suspended in a gravimetric tube furnace of known construction. The yam was used as a continuous length, bound together to make a bundle of ca. 2 g in weight and 20 cm length. Each sample was subjected to a heating programme consisting of:

(1) pyrolysis in oxygen-free nitrogen gas (flow rate, 4 $dm^3$ $min^{-1}$) at a heating rate of 10° C. $min^{-1}$ to 860° C.

(2) activation in carbon dioxide gas (flow rate, 4 $dm^3$ $min^{-1}$) at 850° C. to 860° C. for the time period necessary to obtain the required percentage burn-off; and (3) cooling to ambient temperature in a flow of nitrogen gas.

The nitrogen gas employed for pyrolysis and adsorption measurements was the high purity grade: 99.99% purity. Carbon dioxide gas was 99.75% purity, while the neopentane used was of 99.0% purity. The water employed for sorption studies on a number of samples was initially distilled and then subjected to repeated freezing/thawing cycles in the sorption apparatus prior to use.

2. Characterisation

Following the approach of Sing et al, Langmuir 4 (1988) 740, neopentane was chosen as an adsorptive in addition to nitrogen to assess the effect of molecular diameter on the nature and extent of adsorption on the chars studied. Nitrogen adsorption isotherms were determined at 77° K. Neopentane isotherms were measured at 273° K., water sorption isotherms were determined at 298° K. All samples were outgassed overnight at 250° C. to a residual pressure of $10^{-4}$ mbar prior to the measurement of any such isotherm.

The behaviour of activated Kevlar as a sorbent for carbon dioxide was determined dynamically rather than via the static methods listed above. The sorbent was prepared in the form of a column by packing a number of discs cut with a cork borer as layers (2 to 50) in a short stainless steel tube of 4.6 mm internal diameter. This resulted in column lengths of 1–25 mm being produced. These columns were then incorporated into the manifold of a gas chromatograph to which a hot wire detector had been fitted for $CO_2$ detection. The column was then heated to a suitable regeneration temperature (typically 250° C.) and cooled prior to a series of injections for pure $CO_2$. Peak areas were determined by integration while the transformation of chromatograms to breakthrough data was accomplished using a method described previously by R. A. Hayes in his Ph-D Thesis, Bristol University (1988).

Thermal analyses (DTA, TGA and DTG) were performed on Kevlar 29 cloth. An atmosphere of flowing, dry nitrogen gas (flow rate, 50 $cm^3$ $min^{-1}$) was employed in conjunction with a heating rate of 10° C. $min^{-1}$ up to a maximum temperature of 950° C.

3. RESULTS

3.1. Thermal analyses

Figure 1:
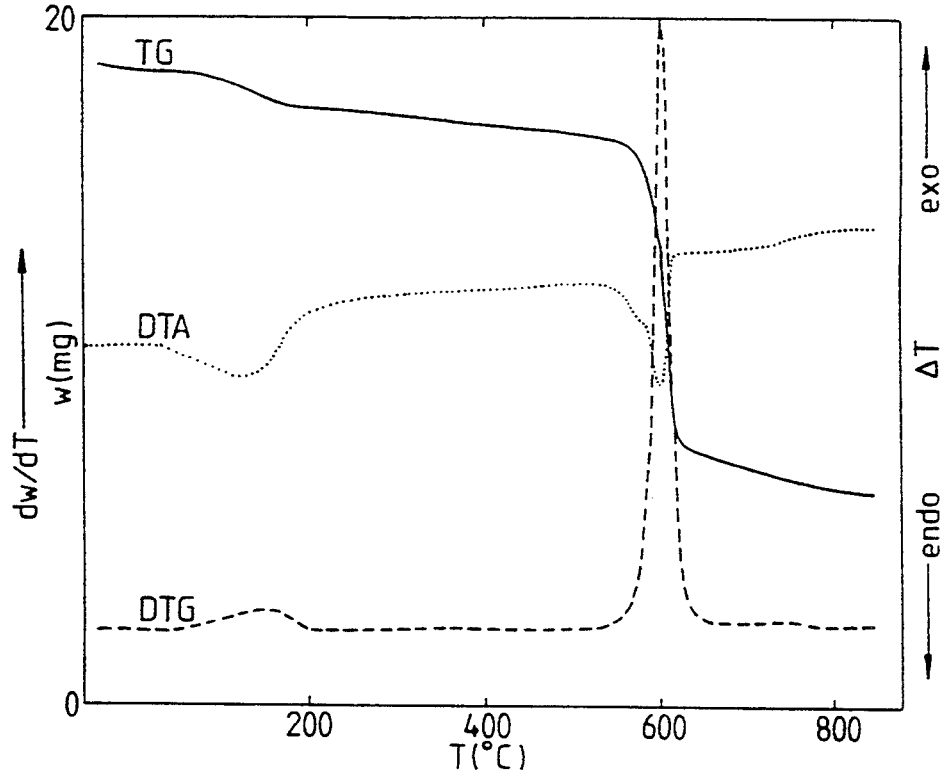
FIG. 1. Thermal analysis curves for Kevlar 29 woven cloth.

Thermal analysis data obtained for the unwashed cloth is shown in FIG. 1. The decomposition was endothermic in all cases, the major DTA peak being at 615° C. with a shoulder at 575° C. The single DTG peak also occurs at 615° C., indicating that the major endotherm is associated with a loss in weight. From the TG curve the char yield at 950° C. is 36.5%.

Data similar to those depicted in the figure were also obtained for all the washed samples irrespective of the acid strength employed, indicating that such treatment has no influence on the subsequent thermal behaviour of the cloth.

3.2. Carbonization and activation

Figure 2:
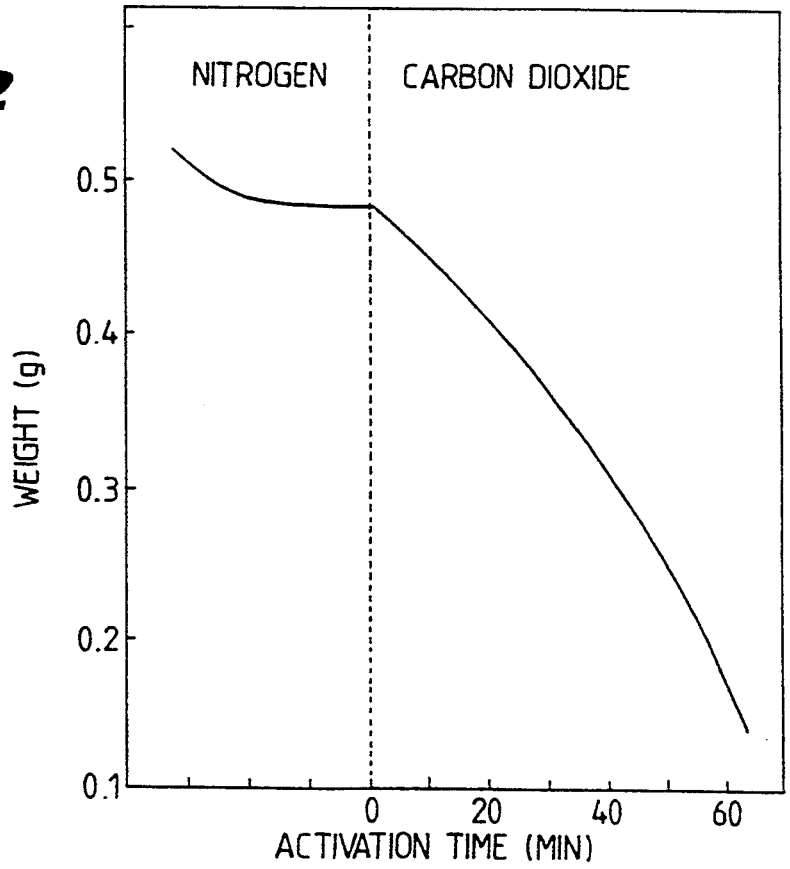
FIG. 2. Representation of a typical chart trace of weight loss versus time obtained from the Cahn Electrobalance during the activation of a sample of Kevlar 29 char in carbon dioxide gas at 860° C.

A typical weight versus time plot obtained from the Cahn Electrobalance associated with the furnace is shown in FIG. 2, for the activation of Kevlar chars in carbon dioxide gas at 860° C. All the unwashed/washed samples gave similar traces demonstrating that washing also has no influence on the activation process. The latter leads to a progressive increase in the rate of weight loss as burn-off proceeds, the average carbonization yield obtained from the weight change during preparation of the chars being 36.5% plus or minus 0.6%.

3.3. Scanning electron microscopy and EDXA

Scanning electron micrographs of the initial unwashed precursor and of the subsequent activated char is provided clear evidence of particular residues on the fibre surface in the initial precursor and this may be linked to extensive granulation of the fibre surface following activation. EDXA studies showed that the elements Ca, Fe, K, Si, S, P, and Al were present in the surface residues with S and K also being present on parts of some fibre surfaces free from visible residues.

Residues associated with the presence of heavy metals were greatly diminished by washing the precursor materials with aqueous HCl solutions of varying concentration, and were virtually eliminated by the use of 3M HCl solutions. In contrast, K and Ca residues appeared to be unaffected by such treatment, and the same applied to S residues which were always present in the fracture surfaces generated on carbonization and activation. The removal of heavy metal residues by washing also deminished the extent of fibre granulation on activation, although such modification of the fibre surface was still visible in materials subjected to prior washing in the strongest acid solutions.

Elemental analyses of (1) a Kevlar textile and (2) two activated products derived from it by the process of the present invention were carried out and the results are expressed below as C:N:S ratios, adjusting C to 100 in each case.

| Sample | C | N | S |
|---|---|---|---|
| (1) Fothergill woven Kevlar 29 (Type D0235/001) | 100 | 16.6 | 0.8 |
| (2) GFK/035/unpretreated/activated | 100 | 9.4 | 1.0 |
| (3) GFK/035/W1 | 100 | 9.3 | 1.0 |

3.4. Nitrogen adsorption

Figure 3:
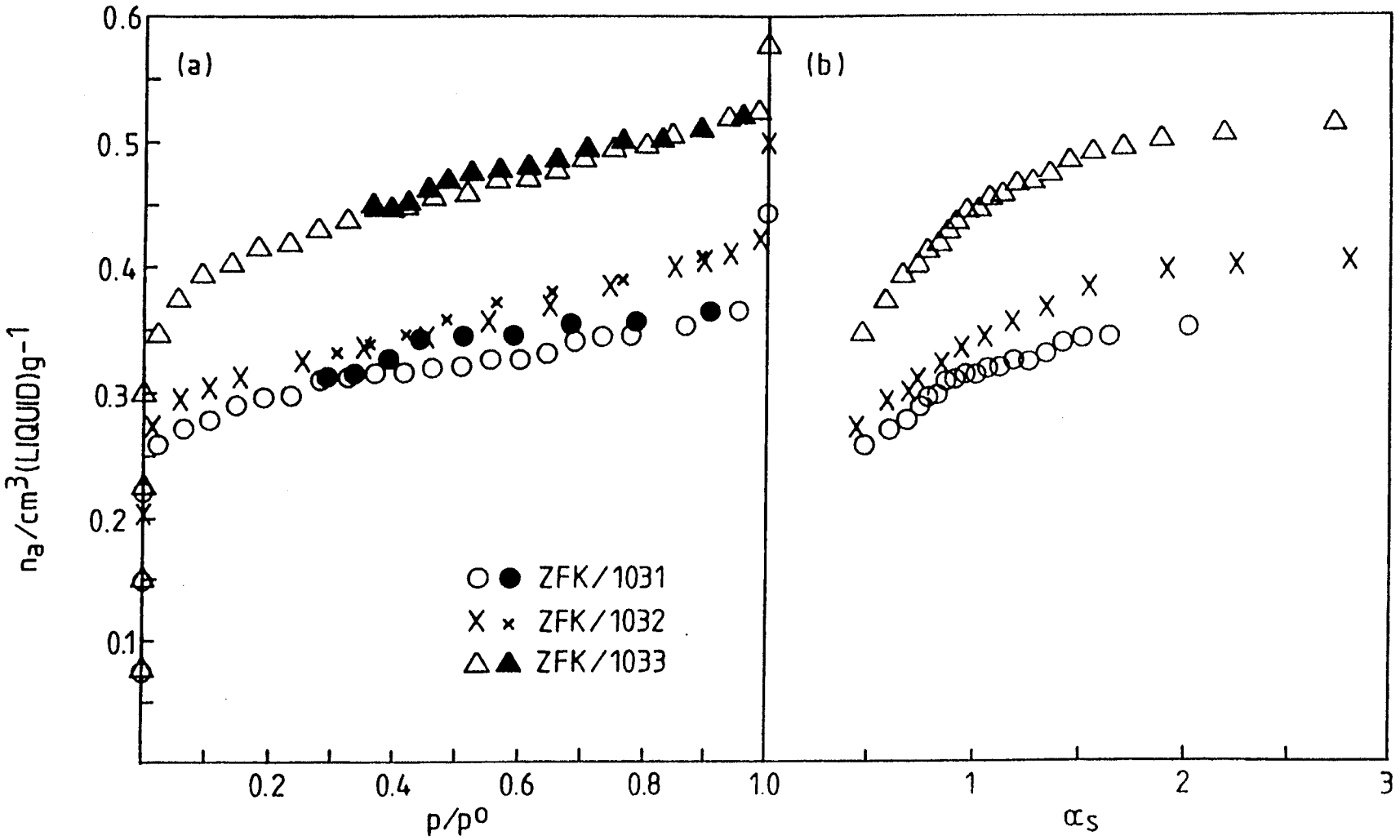
FIG. 3. (*a*) isotherms and (*b*) $\alpha_s$-plots for the adsorption of nitrogen at 77° K. on activated non-woven Kevlar 29 chars.
Figure 4:
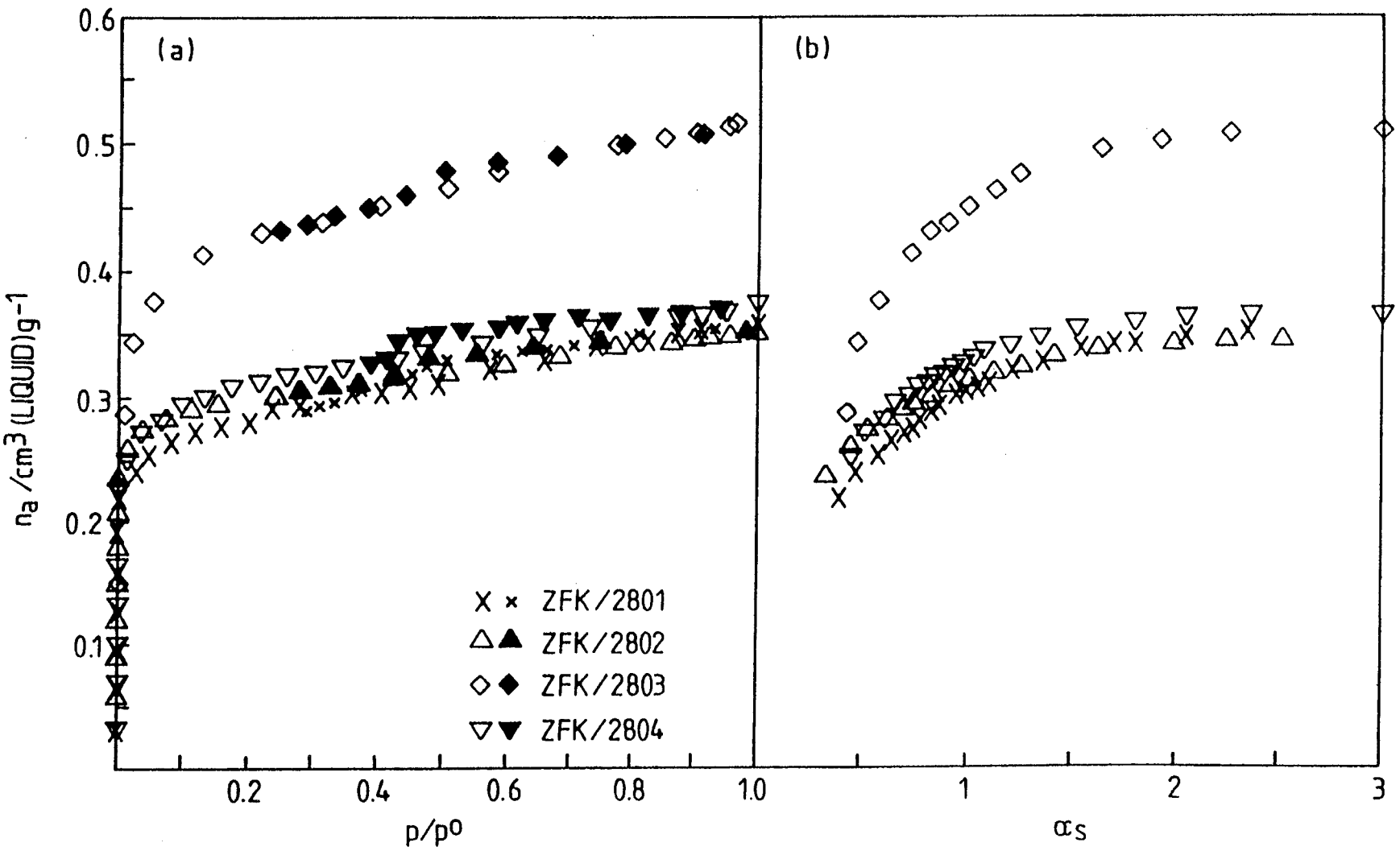
FIG. 4. (*a*) isotherms and (*b*) $\alpha_s$-plots for the adsorption of nitrogen at 77° K. on activated woven Kevlar 29 chars.
Figure 5:
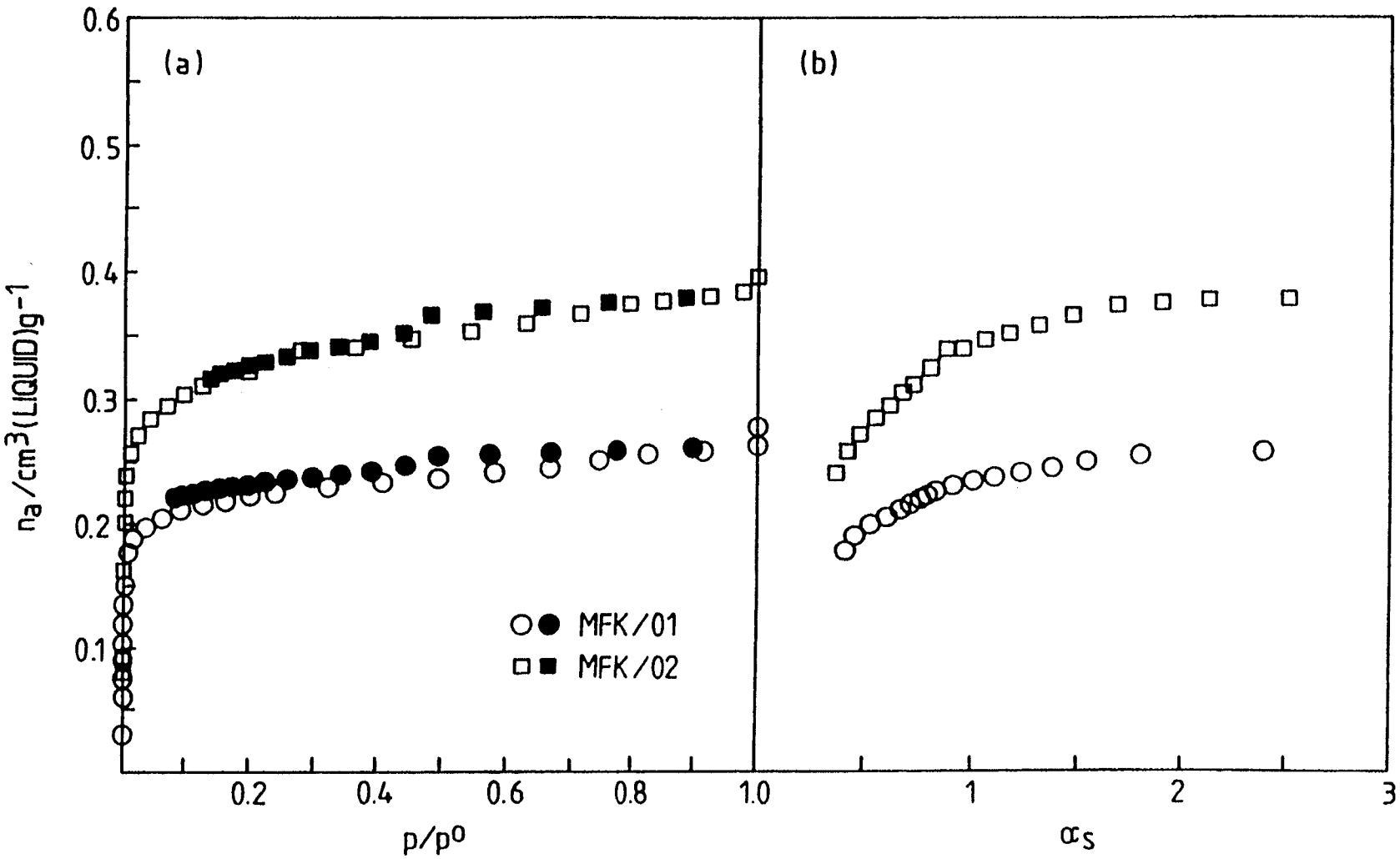
FIG. 5. (*a*) isotherms and (*b*) $\alpha_s$-plots for the adsorption of nitrogen at 77° K. on activated Kevlar 29 chars.

Nitrogen isotherms for activated chars derived from unwashed non-woven and woven textiles and yarn are illustrated in FIGS. 3(*a*) to 5(*a*), respectively. All the isotherms display some Type I character, but most also display a small hysteresis loop. The isotherm obtained for the sample activated to the lowest burn-off (27.4) exhibited low-pressure hysteresis (see FIG. 5(*a*)).

Figure 6:
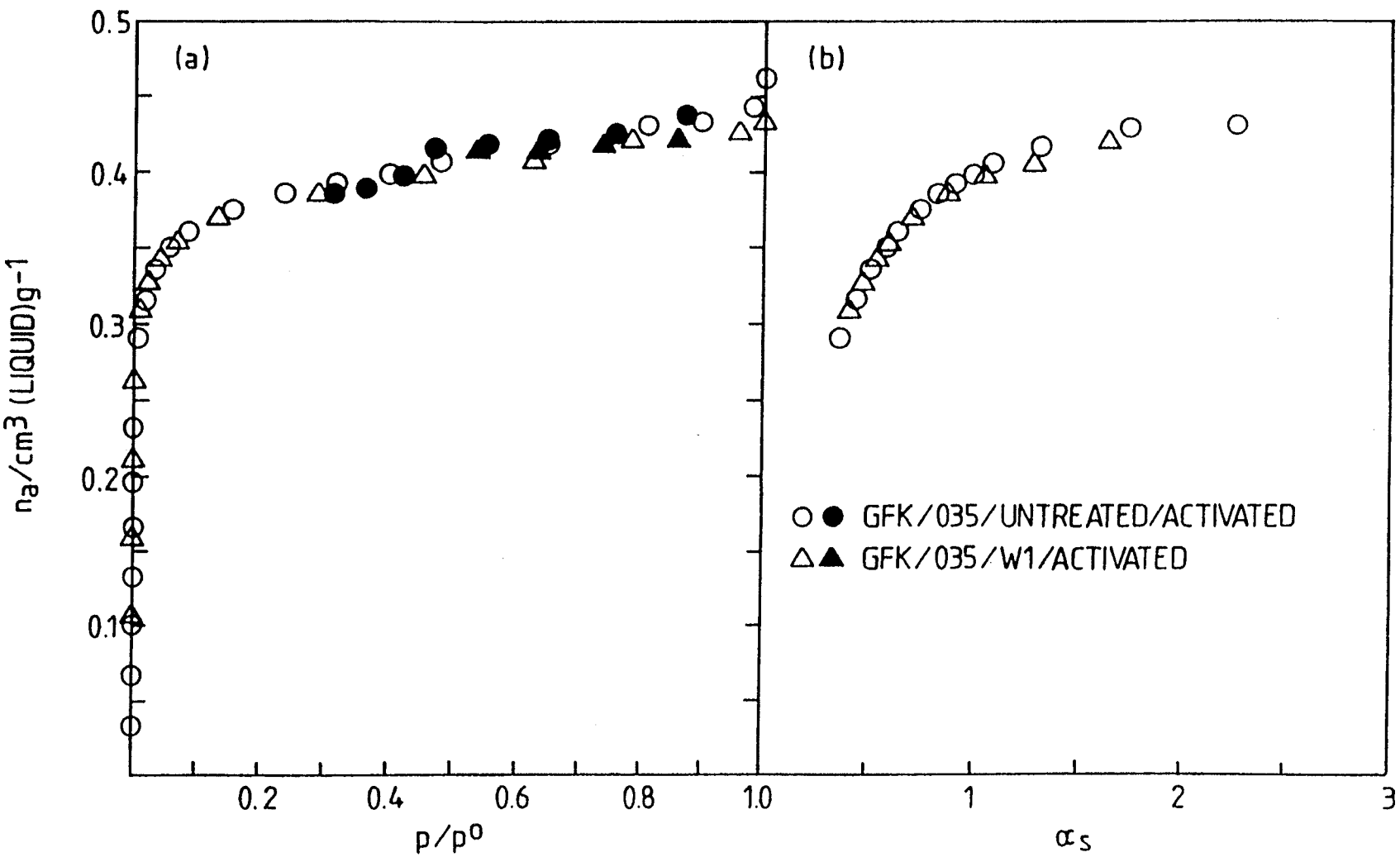
FIG. 6. (*a*) isotherms and (*b*) $\alpha_s$-plots for the adsorption of nitrogen at 77° K. on activated woven Kevlar 29 chars derived from unwashed and acid washed (3M HCl) precursors.

The nitrogen isotherm obtained for a 3M HCl washed sample is shown in FIG. 6(*a*), where it has been compared with the isotherm for the char derived from the unwashed precursor. It will be seen that the isotherms are virtually identical: both exhibit a rapid initial uptake at low relative pressures leading to Type I characteristics; both display small hysteresis loops; and both reach virtually the same maximum uptake of nitrogen at high relative pressures, although that for the washed sample is marginally lower than that for the unwashed.

The corresponding $\alpha_s$-plots (K. S. W. Sing, in D. H. Everett and R. H. Ottewill (eds) "Surface Area Determination" Butterworths, London (1970) 25), constructed using the standard reference data of Carrott et al (Carbon 25 (1987) 769), are depicted in FIGS. 3(*b*) to 6(*b*), respectively. External surface areas and pore volumes have been derived from the slopes and intercepts of the linear regions of the $\alpha_s$-plots associated with these isotherms, as described by Sing et al (Carbon 25 (1987) 59). Not all these plots attain a plateau value at $\alpha_s=1$, the value corresponding to the completion of pope filling, and from this it is clear that values of the 'micropore volume' derived by extrapolation must also include a mesopore contribution. For this reason, the extrapolated values obtained in this work have been designed as total pore volumes. BET surface areas were calculated in the usual way, and the adsorption data derived from the measured isotherms are listed in Table 1 (below).

Figure 7:
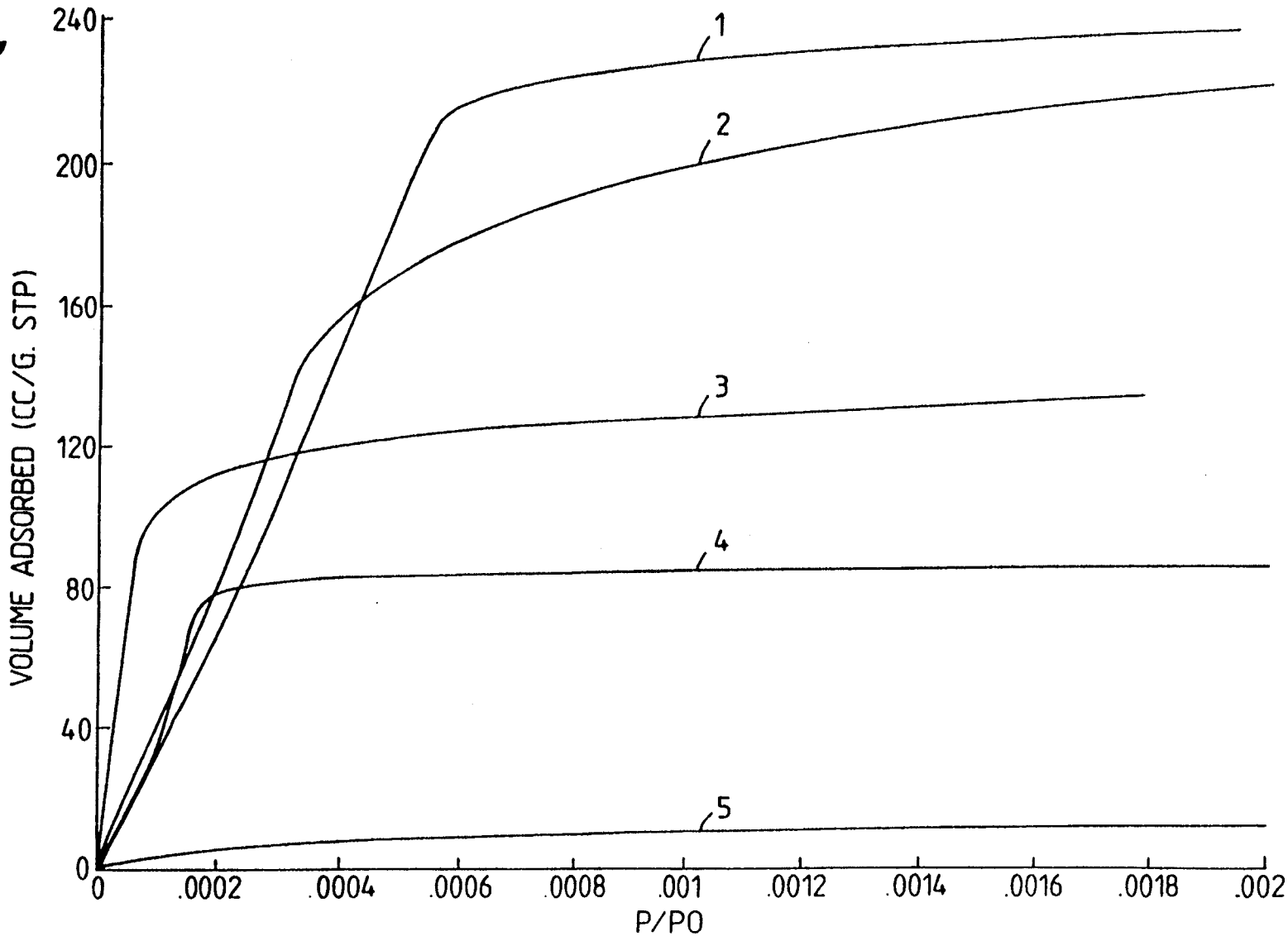
FIG. 7. Nitrogen adsorption isotherms at 77° K. and at very low relative pressures (0–0.002/p°) for various activated carbon samples.

Nitrogen isotherms have also been measured at 77° K. over very low relative pressure ranges (0–0.002/p°), and the sorption curves obtained are depicted in FIG. 7 where they are compared with similar isotherms for other adsorbent materials. This figure demonstrates clearly that the initial uptake of nitrogen with activated chars derived from Kevlar precursors is significantly greater than that exhibited by any of the other materials studied, including Carbosieve, which hitherto had been regarded as outstanding in this respect.

3.5. Neopentane isotherms

Neopentane isotherms for non-woven and woven chaps derived from unwashed precursors ape depicted in FIGS. 8(*a*) and 9(*a*), respectively, together with the $\alpha_s$-plots constructed using the reference data of Carrott et al (Langmuir 4 (1988) 740. (FIGS. 8(*b*) and 9(*b*). The neopentane isotherms differ from those of nitrogen in a number of respects. Thus all the isotherms exhibit low-pressure hysteresis, although that obtained from sample ZFK/1033 which was subjected to the highest percentage burn-off (70.0%) is almost reversible at low relative pressures. The interpretation of the $\alpha_s$plots is also not straightforward, there being some evidence that pore-filling processes overlap in the region around $\alpha_s=1$. Values of the BET surface area and the total pore volume ape again listed in Table 1.

3.6. Water sorption

FIG. 10 depicts the isotherms obtained for water sorption on two samples of activated Kevlar chars derived from unwashed and 3M HCl washed precursors, respectively. Both samples exhibited a substantial and similar uptake of water vapour as the relative pressure was increased, but the maximum uptake of the sample derived from the unwashed material was greater than that obtained with the sample initially subjected to washing.

3.7. Carbon dioxide breakthrough

Activated Kevlar samples derived from unwashed woven precursors interact strongly with carbon dioxide gas. This interaction manifests itself in two interesting ways. Firstly, after being regenerated prior to the injection of $CO_2$ gas, the activated materials appeared capable of retaining a critical volume of the gas with no elution occurring unless the column temperature was increased significantly. Indeed, if the volume of $CO_2$ gas injected was less than the capacity of the column, total retention was then observed. Subsequent injections of $CO_2$ gas resulted in partial and, finally, total elution of the injected volume. Typical results obtained with columns packed with varying numbers of layers of cloth samples activated to different percentage burn-offs are listed in Table 2, which also indicates the retention capacity of the columns in question. In all cases the flow gas employed was helium at a flow rate of 13 $cm^3$ $min^{-1}$, while the column temperature was 40° C. unless otherwise stated.

Secondly, even after saturation with $CO_2$ gas, the activated materials were still capable of separating $CO_2$ from air. This is demonstrated by the chromatogram depicted in FIG. 11, which shows a distinct separation between the peaks for the two gases affected on a column constructed from 30 layers of 60% activated material. Such behaviour was not observed with unactivated samples, indicating that the $CO_2$ activity was not simply due to the presence of metal residues on the unwashed precursor but associated with the porosity induced in the material on activation.

The $CO_2$ breakthrough curves for conventional activated carbon cloths and Kevlar-derived materials are depicted in FIG. 12. There is a major difference between the $CO_2$ activities of the two materials, with that based on Kevlar retaining 283 times more $CO_2$ than carbon cloths derived from viscose rayon precursors, furthermore, the latter cloths showed little ability to separate air end $CO_2$ from gaseous mixtures, in marked contrast to the behaviour of Kevlar-derived materials discussed above.

4. Discussion of results with Kevlar starting materials

Comparison of the nitrogen and neopentane adsorption data for the woven and non-woven chars derived from unwashed precursors reveals that with the exception of sample ZFK/2804 the total amount of nitrogen adsorbed was always greater than that of neopentane (see Table 1). It also appears that the ratio of the total amounts of nitrogen and neopentane adsorbed tends to increase with burn-off, suggesting that the pore structure is becoming progressively less accessible to the larger neopentane molecules as burn-off proceeds. These findings ape contrary to the pattern of pore volume development found in the case of viscose rayon chars, where the agreement between the two measured volumes is poor at low percentage burn-off but improves as the micropores are widened during activation "Characterisation of Porous Solids" Elsevier, Amsterdam (1988) 89. In general, the pore volume obtained for a given percentage burn-off is rather lower for Kevlar-derived chars than from those obtained from viscose rayon.

The Kevlar-derived chaps are also in marked contrast to comparative viscose rayon chars in their affinity to water vapour. Whereas the latter are relatively hydrophobic, with little uptake of water until p/p° values of ca. 0.7 are attained, both Kevlar char samples studied exhibited a pronounced 'knee' in the water isotherm at low relative pressure and a main upswing at $p/p^{\circ}=0.1$ to 0.3 (FIG. 12). This behaviour occurred irrespective of whether the precursor samples were subjected to acid washing prior to carbonization and activation; washing appears to have a more significant effect on the final uptake of water by the materials, with the washed sample exhibiting a lower value than it's unwashed partner.

The presence of sulphur and nitrogen residues distributed throughout the fibres in the Kevlar-derived chaps provides a high concentration of polar sites both on the surface and within the pores themselves. The polar sites on the surface are probably responsible for enhanced uptake of water vapour exhibited by these materials, whereas the existence of such sites within the pores leads to greatly enhanced uptake of $CO_2$ gas exhibited through the operation of polar forces as well as the adsorbate-adsorbent normally present. It will be appreciated that sulphur containing residues are found in virtually all polyarylamide fibres due to use of sulphur containing spin dope compositions, particularly being used in the form of sulphur containing acids such as sulphuric acid. (see "Aromatic High Strength Fibers", H. H. Yang, Wiley Interscience, (1990), pp148) and derivatives, e.g. salts.

5. EXAMPLE 2: Preparation of activated chars from Nomex

Precursor fibres of poly-m-phenylene isophthalamide, sold as Nomex RTM by Du Pont, were used in the form of plain weave woven cloth, sold as Porspen 11 as supplied by P & S Textiles Ltd, Bury, Greater Manchester. The textile was used as received without any prior treatment. Experimental procedures, including carbonization and activation conditions were the same as those employed in the preparation of the Kevlar chars described at 1. above. Carbon dioxide-activated chars were prepared with burn-offs of 25, 50 and 75% (based on the carbonized weight). The activated chars were characterised by measurement of the nitrogen isotherm at 77° K.

6. Results using Nomex starting materials

FIG. 13 shows the nitrogen absorption isotherms obtained for the activated Nomex chars. It is immediately apparent that the chars differ substantially from those derived from Kevlar with regard to some properties and differ substantially from viscose rayon derived chars as compared to both those fibres chars of comparable burn-off. The Nomex chars possess a very narrow distribution of micropore sizes, as indicated by the highly rectangular shape of the isotherms, even at burn-off as high as 75%. Such a narrow micropore size distribution provides the prospect of molecular sieve uses for these materials.

A further contrast with the other char types mentioned is the absence of a hysteresis loop at high relative pressures and, hence, of mesoporosity. The isotherm of the sample activated to 75% burn-off does exhibit some hysteresis, but this extends to low pressures and may be related to to irreversible swelling of the carbon structure by the adsorbed nitrogen rather than the presence of mesoporosity. Adsorptive properties of the chars are summarised in Table 3.

The rate of burn-off of carbonized Nomex in carbon dioxide at the activation temperature of 850° C. to 860° C. was found to be substantially slower than either unwashed or acid washed Kevlar chars. Furthermore, the rate did not increase during burn-off as in the case of Kevlar. These two observations suggest that catalytically active inorganic residues present in the Kevlar are absent from Nomex chars. A further surprising observation is the exceptionally high carbon yield obtained using Nomex; a value of 47.5% at 850° C. being typical. The char fibres are notably brittle and are incapable of being bent without breakage; it can be readily seen that powdered forms of this product would offer advantages of increased surface area for enhancement of adsorptive uses.

TABLE 1

| | Nitrogen and neopentane adsorption on Kevlar 29 | | | | | | |
|---|---|---|---|---|---|---|---|
| | | Nitrogen adsorption | | | Neopentane adsorption | | |
| Sample | Burn-off (%) | $A_{BET}^N$ $m^2g^{-1}$ | $A_s^N$ $m^2g^{-1}$ | $V_p^N$ $cm^3g^{-1}$ | $A_{BET}^N$ $m^2g^{-1}$ | $A_s^N$ $m^2g^{-1}$ | $V_p^N$ $cm^3g^{-1}$ |
| Non-woven | | | | | | | |
| ZFK/1031 | 32 | 691 | 22 | 0.33 | 738 | 7 | 0.30 |
| ZFK/1032 | 51.5 | 790 | 18 | 0.38 | 544 | 6 | 0.26 |
| ZFK/1033 | 70.0 | 985 | 26 | 0.48 | 726 | 4 | 0.30 |
| Woven | | | | | | | |
| ZFK/2801 | 31.2 | 692 | 29 | 0.32 | 602 | <1 | 0.28 |
| ZFK/2802 | 42.4 | 750 | 6 | 0.34 | 685 | 4 | 0.27 |
| ZFK/2803 | 59.1 | 1077 | 11 | 0.50 | 1017 | 6 | 0.42 |
| ZFK/2804 | 47.3 | 803 | 8 | 0.36 | 857 | 8 | 0.36 |
| Yarn | | | | | | | |
| MFK/01 | 27.4 | 537 | 16 | 0.24 | — | — | — |
| MFK/02 | 53.0 | 789 | 12 | 0.36 | — | — | — |

TABLE 2

| | | | Carbon dioxide breakthrough data | | | | |
|---|---|---|---|---|---|---|---|
| | | | | | Carbon dioxide volumes | | |
| Sample | Burn-off (%) | Regeneration temp. (°C.) | No. of cloth layers employed /weight (g) | Column temp. (°C.) | $\Sigma^{v}$injected (microliters) | $^{v}$eluted (microliters) | $^{v}$retained (microliters) |
| ZFK | 30 | 250 | 5/0.0127 | 40 | 5 | 0.0 | 5.0 |
| | | | | | 10 | 1.7 | 3.3 |
| | | | | | 15 | 3.3 | 1.7 |
| | | | | | 20 | 5.0 | — |
| | | | | | 25 | 4.8 | — |

TABLE 2-continued

| Sample | Burn-off (%) | Regeneration temp. (°C.) | No. of cloth layers employed /weight (g) | Column temp. (°C.) | Carbon dioxide breakthrough data: Carbon dioxide volumes: $\Sigma^{v}$injected (microliters) | $^{v}$eluted (microliters) | $^{v}$retained (microliters) |
|---|---|---|---|---|---|---|---|
| | | | | | | | =10.0 |
| | | | | | | | $\Sigma^{v}_{retained}$ = 0.79 $cm^3g^{-1}$ |
| ZFK | 30 | 250 | 5/0.0127 | 40 | 10 | 3.0 | 7.0 |
| | | | | | 20 | 10.0 | — |
| | | | | | 30 | 8.6 | — |
| | | | | | | | =7.0 |
| | | | | | | | $\Sigma^{v}_{retained}$ = 0.55 $cm^3g^{-1}$ |
| ZFK | 40 | 110 | 30/0.0550 | 40 | 50 | 2.1 | 47.9 |
| | | | | | 100 | 39.9 | 10.1 |
| | | | | | 150 | 50.0 | — |
| | | | | | 200 | 48.9 | — |
| | | | | | | | =58.0 |
| | | | | | | | $\Sigma^{v}_{retained}$ = 1.05 $cm^3g^{-1}$ |
| ZFK | 40 | 110 | 30/0.0550 | 40 | 100 | 28.7 | 71.3 |
| | | | | | 200 | 91.2 | 8.8 |
| | | | | | 300 | 100.0 | — |
| | | | | | 400 | 98.1 | — |
| | | | | | | | =80.1 |
| | | | | | | | $\Sigma^{v}_{retained}$ = 1.46 $cm^3g^{-1}$ |
| ZFK | 40 | 250 | 30/0.0550 | 40 | 50 | 8.1 | 41.9 |
| | | | | | 100 | 30.4 | 19.6 |
| | | | | | 150 | 38.5 | 11.5 |
| | | | | | 200 | 44.6 | 5.4 |
| | | | | | 250 | 50.0 | — |
| | | | | | 300 | 48.0 | — |
| | | | | | | | =78.4 |
| | | | | | | | $\Sigma^{v}_{retained}$ = 1.43 $cm^3g^{-1}$ |
| ZFK | 40 | 250 | 30/0.0550 | 110 | 20 | 2.6 | 17.4 |
| | | | | | 40 | 20.0 | — |
| | | | | | 60 | 19.2 | — |
| | | | | | | | =17.4 |
| | | | | | | | $\Sigma^{v}_{retained}$ = 0.32 $cm^3g^{-1}$ |
| ZFK | 40 | 250 | 30/0.0550 | 110 | 30 | 0.0 | 30.0 |
| | | | | | 60 | 18.0 | 12.0 |
| | | | | | 90 | 29.3 | 1.7 |
| | | | | | 120 | 30.0 | — |
| | | | | | | | =43.7 |
| | | | | | | | $\Sigma^{v}_{retained}$ = 0.79 $cm^3g^{-1}$ |
| ZFK | 40 | 250 | 30/0.0550 | 110 | 200 | 133.4 | 66.6 |
| | | | | | 400 | 192.0 | 8.0 |
| | | | | | 600 | 200.0 | — |
| | | | | | | | =74.6 |
| | | | | | | | $\Sigma^{v}_{retained}$ = 1.36 $cm^3g^{-1}$ |
| ZFK | 40 | 400 | 30/0.0550 | 110 | 100 | 39.7 | 60.3 |
| | | | | | 200 | 94.9 | 5.1 |
| | | | | | 300 | 100.0 | — |
| | | | | | | | =65.4 |
| | | | | | | | $\Sigma^{v}_{retained}$ = 1.19 $cm^3g^{-1}$ |
| ZFK | 60 | 250 | 30/0.0513 | 110 | 50 | 1.1 | 48.9 |
| | | | | | 100 | 30.9 | 19.1 |
| | | | | | 150 | 44.3 | 5.7 |
| | | | | | 200 | 48.3 | 1.7 |
| | | | | | 250 | 50.0 | — |
| | | | | | | | =75.3 |
| | | | | | | | $\Sigma^{v}_{retained}$ = 1.47 $cm^3g^{-1}$ |

TABLE 3

Summary of nitrogen adsorption data for Nomex derived chars

| Burn-off (%) | BET surface area ($m^2 g^{-1}$) | Total pore volume ($cm^3 g^{-1}$) |
|---|---|---|
| 25 | 703 | 0.25 |
| 50 | 938 | 0.36 |
| 75 | 1195 | 0.50 |

We claim:

1. A process for separating carbon dioxide from a gaseous mixture by contacting the mixture with a fibrous adsorbent activated carbon whereby the polar molecules are preferentially adsorbed, wherein the activated carbon is prepared by carbonizing a material comprising polyarylamide fiber which is a condensation product of 1,4-diaminobenzene and terephthalic acid, at a temperature of about 840° C. to about 880° C. and activating the carbonized product in an activating carbon dioxide-containing atmosphere at an elevated temperature of about 840° C. to about 880° C., the overall weight loss of the fiber during the process being 73% to 91% of the starting weight of the fiber.

2. A process according to claim 1 wherein the polyarylamide comprises sulphur containing materials derived from its manufacture.

3. A process according to claim 2 wherein the activated carbon material comprises carbon, nitrogen and sulphur in the ratio range 100:9:0.5 to 100:10:1.5, having a carbon dioxide retention $\Sigma V_{retained}$ of at least 0.5 $cm^3$ $g^{-1}$ at 40° C. and having carbonized aromatic ring structures therein.

4. A process according to claim 1 wherein the polyarylamide has been produced using a sulphuric acid based spin dope.

5. A process according to claim 1 wherein the material is heated gradually to the carbonization temperature.

6. A process according to claim 5 wherein the material is heated at 1° to 20° C. $min^{-1}$ to the carbonization temperature.

7. A process according to claim 5 wherein the material is heated at 5° to 15° C. $min^{-1}$ to the carbonization temperature.

8. A process according to claim 5 wherein the material is heated at about 10° C. $min^{-1}$ to the carbonization temperature.

9. A process according to claim 1 wherein the activating atmosphere is selected from the group consisting of a carbon dioxide, steam, hydrogen, combustion gases and mixtures of these.

10. A process according to claim 1 wherein the overall weight loss of the fibre during the process is 73% to 91% of the starting weight of the fibre, corresponding to a burn-off of 25% to 75%.

11. A process according to claim 10 wherein the overall weight loss is 78% to 85%, corresponding to a burn-off of 40% to 60%.

12. A process according to claim 1 which includes the additional step of washing the fibre with an acid, an alkali and/or an organic solvent prior to carbonization.

13. A process according to claim 12 wherein the fibre is washed with hydrochloric acid.

14. A process according to claim 1 wherein the polyarylamide is a condensation product of 1,4-diaminobenzene and terephthalic acid, the carbonization and activation steps being carried out at 840° C. to 880° C., the activating atmosphere being carbon dioxide and the overall weight loss of the fibre during the process being 73% to 91% of the starting weight of the fibre.

15. A process according to claim 1 wherein the carbon dioxide retention value $\Sigma V_{retention}$ is at least 1.4 $cm^3$ $g^{-1}$ at 40° C.

16. A process according to claim 1 wherein the activated carbon is in a divided form.

17. A process according to claim 1 for the separation of carbon dioxide from air.

* * * * *